United States Patent [19]

Essig

[11] Patent Number: 4,685,304

[45] Date of Patent: Aug. 11, 1987

[54] METHOD AND APPARATUS FOR FORMING CUBE OF FROZEN LIQUID

[76] Inventor: Robert A. Essig, 3802 Zane Ave. North, Crystal, Minn. 55422

[21] Appl. No.: 829,449

[22] Filed: Feb. 13, 1986

[51] Int. Cl.[4] ..... F25C 1/20

[52] U.S. Cl. ..... 62/68; 62/1; 62/73; 249/140; 426/66; 426/87; 426/104; 426/383; 426/515

[58] Field of Search ..... 62/1, 66, 68, 71, 73, 62/340, 352, 353; 249/140; 426/66, 87, 104, 383, 515

[56] References Cited

U.S. PATENT DOCUMENTS

| | | | |
|---|---|---|---|
| 90,591 | 8/1933 | O'Leary . | |
| 263,398 | 3/1982 | Tiller . | |
| 274,592 | 7/1984 | Bever . | |
| 2,109,822 | 3/1938 | Eddy . | |
| 2,133,521 | 10/1938 | Wussow . | |
| 2,253,512 | 8/1941 | Fechner . | |
| 2,312,511 | 3/1943 | Weinberg . | |
| 2,514,942 | 7/1950 | Eaton | 62/1 X |
| 2,591,261 | 4/1952 | Holahan . | |
| 2,722,110 | 11/1955 | Denzer . | |
| 2,723,536 | 11/1955 | Mason . | |
| 2,756,567 | 7/1956 | Martin . | |
| 2,892,323 | 6/1959 | Woodmark et al. . | |
| 2,954,679 | 10/1960 | Blackett | 62/353 X |
| 3,026,691 | 3/1962 | Van Heyst . | |
| 3,121,627 | 2/1964 | Harris, Jr. | 62/340 X |
| 3,146,606 | 9/1964 | Grimes et al. . | |
| 3,171,267 | 3/1965 | Mitchell . | |
| 3,254,501 | 6/1966 | Brysselbout . | |
| 3,289,430 | 12/1966 | Dedricks et al. . | |
| 3,318,105 | 5/1967 | Burroughs . | |
| 3,380,261 | 4/1968 | Hendrix et al. . | |
| 3,418,823 | 5/1968 | Vivai . | |
| 3,433,030 | 3/1969 | Jacobs . | |
| 3,526,100 | 9/1970 | Briel | 62/340 X |
| 3,538,720 | 11/1970 | Feola . | |
| 4,045,979 | 9/1977 | Mazzini . | |
| 4,199,956 | 4/1980 | Lunde . | |
| 4,207,750 | 6/1980 | Simkens | 62/352 X |
| 4,255,941 | 3/1981 | Bonloy | 62/347 |
| 4,276,751 | 7/1981 | Saltzman et al. . | |
| 4,424,601 | 1/1984 | Weber . | |

*Primary Examiner*—William E. Tapolcai

*Attorney, Agent, or Firm*—Merchant, Gould, Smith, Edell, Welter & Schmidt

[57] ABSTRACT

A method and apparatus are disclosed for forming a monogrammed ice cube. The ice cube is formed by providing a die of conductive material with a shape which corresponds to the shape of a desired imprint to be formed in the cube. The die to conductively connected to a source of a coolant. With the die immersed in water, coolant is supplied to the die to cool it to a temperature below the freezing point of water. The water freezes around the die. The freezing of the water around the die is performed under conditions with the frozen water adjacent the die being clouded and the frozen water spaced from the die being clear. When the completed cube is formed, the clouded portion surrounding the imprint highlights the imprint when the cube is placed in a beverage.

7 Claims, 16 Drawing Figures

FIG. 6
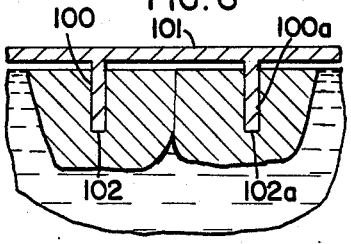
FIG. 7
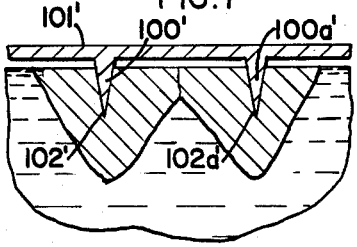
FIG. 8
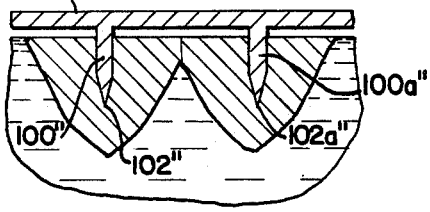
FIG. 9
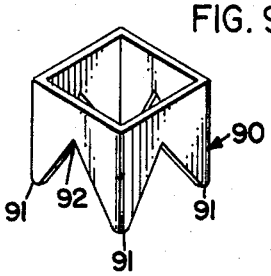
FIG. 10
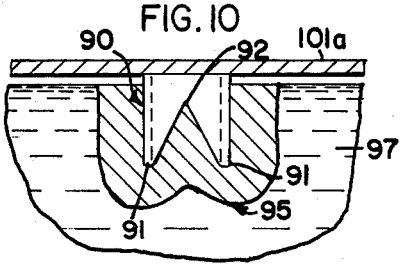
FIG. 14
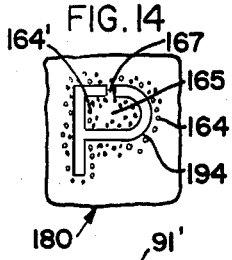
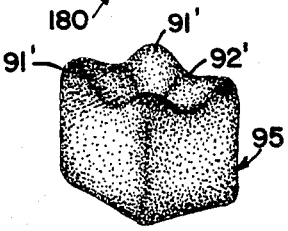
FIG. 15
FIG. 11
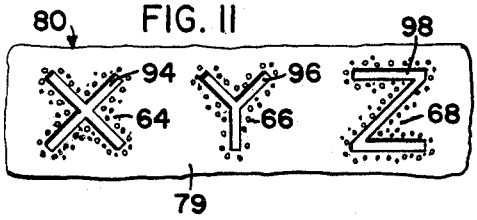
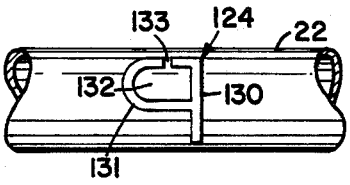
FIG. 12
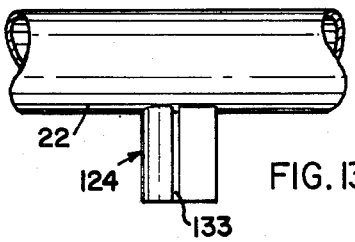
FIG. 13

METHOD AND APPARATUS FOR FORMING CUBE OF FROZEN LIQUID

BACKGROUND OF THE INVENTION

I. Field of the Invention

The present invention pertains to a method and apparatus for forming a cube of frozen liquid. More particularly, the present invention pertains to a method and apparatus for forming an ice cube having a discernible monogram.

II. Description of the Prior Art

In the prior art, there are many teachings pertaining to the fabrication of ice cubes. These teachings include methods and apparatus for forming novelty ice cubes. Novelty ice cubes include ice cubes having fanciful shapes. For example, U.S. Pat. Design No. 263,398 to Tiller dated Mar. 16, 1982 shows an ice tray which would appear to form ice cubes having the configuration of the State of Texas. U.S. Pat. No. 2,756,567 to Martin dated July 31, 1956 teaches a freezing tray with a plurality of molds having various fanciful configurations. In these examples of prior art freezing trays, the liquid to be frozen is poured into the mold and the filled mold is placed in a freezer unit where the liquid freezes and assumes the shape of its container.

At this point, it is appropriate to mention the use of the word "cube" throughout this application and the appended claims is used to refer to pieces of ice made for drinks. A common understanding of the word "cube" is intended. Accordingly, the word "cube" is not intended to be limited to a strict geometric definition and is meant to be referred to common pieces of ice for drinks which are rarely geometric cubes. It is well understood that ice cubes come in a variety of geometric shapes which include half moons and rounded cubes.

In making ice cubes with ice trays used in the home, tap water is poured into the tray and the filled tray is frozen with the individual cubes being formed. The tap water which is used to make the ice cubes contains numerous minerals and dissolved gasses. As the ice cube freezes, the presence of these minerals and dissolved gasses causes the completed ice cube to be cloudy. Also, the formation of the ice cube in the common ice tray results in fractures of the ice cube which further makes it cloudy and unclear. The sequence of formation of the ordinary ice cube which is clouded due to fractures and dissolved minerals and gasses is shown in U.S. Pat. No. 3,318,105 to Burroughs et al. dated May 9, 1967.

While ice cubes having contained fractures, dissolved gasses and dissolved minerals are fine for home use, industrial institutions such as restaurants, hotels and cocktail lounges have shown a preference for ice cubes which are clear and free of fractures and dissolved gasses and minerals. To accommodate the desires of these users, various methods and apparatus have been developed to form ice cubes which are crystal clear. These methods include cyclically dipping a die in water or immersing a die in water and agitating the water. An example of the former is shown in U.S. Pat. No. 3,418,823 to Vivai dated May 15, 1967. In this teaching, a plurality of molds are sequentially dipped into a pan of water to form successive ice layers which subsequently grow into an ice cube of desired size. Formation of several ice layers insures the completed ice cube will be transparent. As stated in Vivai, it is also important the water be stirred. An example of the latter is found in U.S. Pat. No. 4,199,956 to Lunde dated Apr. 29, 1980.

Paddles are used to agitate the water. In U.S. Pat. No. 2,253,512 to Fechner et al. a propeller stirs a water bath to provide agitation. As noted in U.S. Pat. No. 4,199,956 the art has known that agitation or movement of the water during the freezing is necessary to form the clear ice cube. The agitation washes gasses and minerals away from the surface of the ice cube during its formation. Agitation can be provided through mechanical means such as paddles or it can be provided due to convection currents found in the ice making apparatus. The amount of agitation which is necessary will vary depending upon the chemistry of the water. Namely, the exact amount of agitation must be selected to account for changes in oxygen and other gas content as well mineral content of the water. Commonly, this can be attained through a small amount of trial and error for a particular water source.

Another example of an apparatus for making clear ice cubes is found in U.S. Pat. No. 3,254,501 to Brysselbout dated June 7, 1966. In this technique, water is sprayed into a cavity which is being cooled. Since the water is being frozen while it is motion, a clear ice cube is formed.

OBJECTS AND SUMMARY OF THE PRESENT INVENTION

It is an object of the present invention is to provide a method and apparatus for forming a cube of frozen liquid which includes a monogram formed in the cube.

A further object of the present invention to provide a method and apparatus for forming a cube of frozen liquid to provide a completed cube having controlled decorative contours.

A yet further object of the present invention is to provide a method and apparatus for forming a cube of frozen liquid with a pattern formed in the cube which is clearly observable when the cube is placed in a liquid.

According to a preferred embodiment of the present invention a method is disclosed for forming a monogrammed cube of frozen liquid. The method includes forming a die of conductive material which has a shape corresponding to a shape of a desired imprint to be formed in the cube. The die is connected to a source of coolant and immersed in a bath of the liquid. The immersed die is cooled to a temperature below the freezing point of the liquid. The liquid is frozen about the die under conditions with the frozen liquid adjacent the die being clouded and with the frozen liquid spaced from the die being clear. Freezing of the liquid around the die is continued until the completed cube is formed on the die. The completed cube is removed from the die by heating the die element.

BRIEF DESCRIPTION OF THE DRAWINGS

FIGS. 6 through 8 show examples of contour control of an ice cube formed according to the present invention;

FIG. 9 shows a die according to the present invention for controlling contour of an ice cube during formation;

FIG. 10 is a view of the die of FIG. 9 in use;

FIG. 11 is a view of a completed ice cube made by the apparatus of FIGS. 1 through 5;

FIG. 12 is a view of a die for forming an imprint of the letter "P" in an ice cube;

FIG. 13 is a view taken in elevation of the die of FIG. 12;

FIG. 14 is a view of an ice cube formed on the die of FIG. 12; and

FIG. 15 is a perspective view of an ice cube made on the die of FIG. 9.

DESCRIPTION OF THE PREFERRED EMBODIMENT

Figure 1:
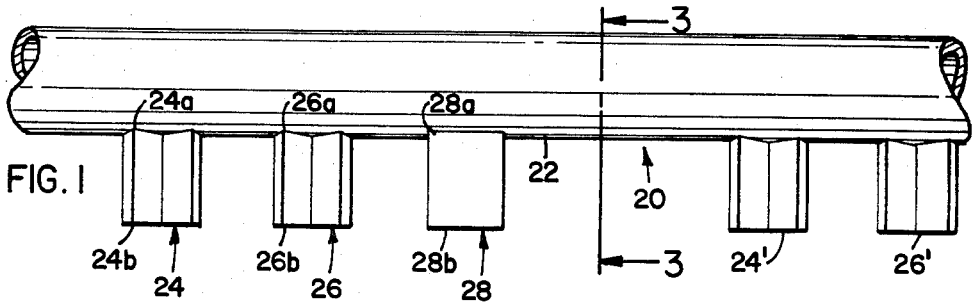
FIG. 1 is a view taken in elevation of an apparatus for forming ice cubes according to the present invention.

Referring to the drawings, FIGS. 1 through 5 show an apparatus for the formation of ice cubes which are monogrammed. That is, the ice cubes include an imprint of desired formation. With use of this apparatus in accordance with the method of the present invention, an ice cube may be formed which has an imprint of desired shape with cloudiness of the cube controlled to enhance the visibility of the monogram when the ice cube is placed in water or other beverage. In the examples, an ice cube will be described with the monogram of "XYZ". It will be appreciated this selection of a monogram is illustrative only and it is intended that the present invention will be applicable to ice cubes having a wide variety of monograms including names of business establishments and products as well as fanciful designs.

With reference to FIG. 1, an apparatus 20 is generally shown for the formation of a plurality of monogrammed ice cubes each having an imprinted monogram "XYZ". The apparatus 20 includes a coolant supply tube 22 which is disposed in a horizontal plane and is formed of thermally conductive material. Preferably, the material of tube 22 is selected to have a high coefficient of heat transfer. Examples of such materials are copper and aluminum. In use for making ice cubes, the copper should be tin plated. However, throughout this application, the word "copper" only will be used and it will be understood to mean tin plated copper.

Disposed on the bottom of horizontal tube 22 are a plurality of dies. The plurality of dies include a first die 24 for forming an imprint of an "X" (which may conveniently be referred to as the X-die) Also included is a second die 26 for forming a "Y" (hereinafter the Y-die) and a third die 28 for forming an imprint of a "Z" (hereinafter the Z-die).

Figure 2:
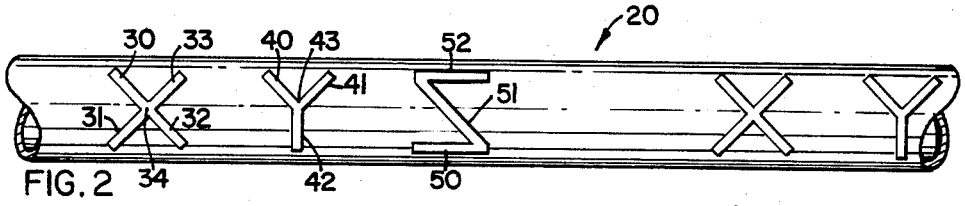
FIG. 2 is a view from the bottom of the view of FIG. 1.

As shown in FIGS. 1 and 2, dies 24, 26 and 28 are disposed in a desired sequence and spaced apart a desired spacing so as to be formed in a single cube. As can also be shown in FIGS. 1 and 2 additional sequences of dies are provided on the bottom of tube 22 as indicated by the second X-die 24' and second Y-die 26' shown in the drawings. The second sequence of dies 24', 26' is separated from the first sequence 24, 26 and 28 by a distance greater than the distance between dies within the same sequence. By reason of having a plurality of die sequences provided on the same tube 22, tube 22 can be used to form a plurality of monogrammed ice cubes according to the method of the present invention which will be more fully described.

Each of dies 24, 26 and 28 are formed from a thermally conductive material such as copper or aluminum. The dies are formed with longitudinal parallel surfaces extending from a connecting end 24*a*, 26*a* and 28*a* to a free end 24*b*, 26*b* and 28*b*. As shown best in FIG. 2, the cross sections taken perpendicular to the longitudinal dimension of the dies presents a shape of the desired imprint for each of the dies. When viewed from the free end, it will be noted that the dies are mirror images of a desired shape. While this is not apparent with respect to the X-die 24 and Y-die 26 (which are symmetrical about an axis extending parallel to the direction of height of their respective letters), it is seen in the Z-die 28 that the die is formed to be a mirror image of its intended character (when the die is viewed from beneath free end 28*b*). The mirror image shape is necessary to make a monogram readable from the top of the cube (i.e. viewing the surface having the imprints). If it is desirable to have the monogram be readable from the back of the cube, the die cross sections will not be mirror images of the intended imprint but will be the actual cross section. In order for the dies to form a plurality of imprints in a single ice cube, the dies are preferably made as thin as possible such that the thickness of each of the die segments will be preferably kept to no more than 1/16 inch thick.

According to the preferred embodiment of the present invention, each of the dies 24, 26 and 28 are provided with a plurality of die forming segments For example, X-die 24 includes segments of sheets of copper such as segments 30, 31, 32 and 33 with their longitudinal edges formed together at the center 34 of the X-die 24 and arranged in the desired shape of an X cross section Similarly, Y-die 26 is formed from three flat sheets of copper which include segments 40, 41 and 42 with their longitudinal edges joined at a common point 43 and arranged to have the cross section of a Y. Likewise, Z-die 28 is formed from flat thin sheets of copper to include first sheet 50, second sheet 51 and third sheet 52. First sheet 50 and second sheet 51 are joined at a common longitudinal edge and third sheet 52 and second sheet 51 are joined at an opposite common longitudinal edge to form a die 28 having the desired cross section Z shape.

In each of dies 24, 26 and 28 the segments formed of the thin sheets of copper are joined at a sharp angle at their common joined edge. In other words, there is no smooth transition along the surface of the die between the die defining segments. As a result of this geometry, the die segments act as barriers to water flow along the surface of the die. This geometry provides surprising benefits in the method of formation of a monogrammed ice cube as will now be described.

Figure 4:
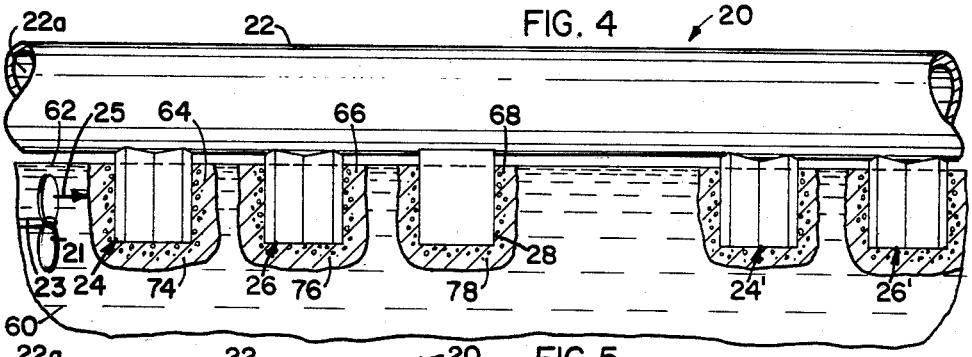
FIGS. 4 and 5 show sequential formation of an ice cube according to the present invention.

Referring now to FIG. 4, the tube 22 with its depending dies 24, 26 and 28 is shown with the dies immersed in a bath of water 60 with the upper level 62 of the water 60 spaced from the bottom of tube 22. With the dies so immersed, any suitable coolant or refrigerant may be pumped through the interior 22*a* of tube 22. The coolant flowing through tube 22 draws heat from tube 22 and the thermally conductive material from which dies 24, 26 and 28 are formed. As the dies cool to a temperature below the freezing point of the water 60, ice crystals will form on the die surfaces.

Figure 3:
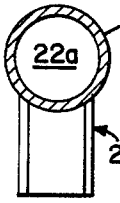
FIG. 3 is a view taken along III—III of FIG. 1.
Figure 3A:
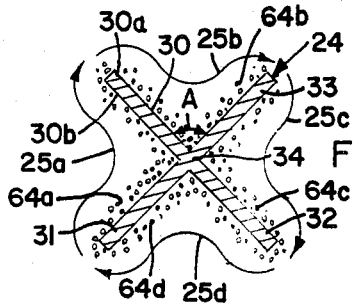
FIG. 3*a* is a view of water flow around the surface of a die according to the present invention.
Figure 5:
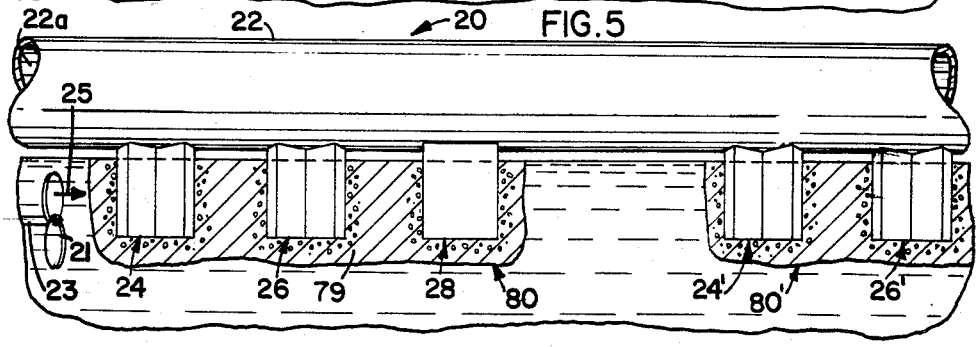

Concurrent with the cooling and induced ice formation, the water bath 60 is agitated to generate water currents within the water bath 60. The agitation and resulting water currents can be formed through mechanical agitation such as paddles or may be induced by convection currents or any other conventional means. In FIGS. 4 and 5, agitation is provided by a propeller 21 secured to a rotary shaft 23. As shaft 23 and propeller 21 rotate, the propeller 21 generates a water current (indicated by arrows 25) in bath 60. The amount of agitation will be preferably controlled in response to the chemistry of the particular water being used such that the water in close proximity to the die surfaces will be unagitated and the water spaced from the die surfaces will be agitated. This difference in the agitation of the water is in response to the sharp angles joining each of the surface segments which comprise the outer surface of each of the die elements. This is best shown with reference to FIG. 3*a* where X-die 24 is used as an example.

As previously discussed, each of sheet segments 30, 31, 32 and 33 are joined at a common edge or center point 34 such that adjacent segments are joined at a sharp angle which is V-shaped. (An example is angle A disposed between segments 30 and 33. Identical angles are formed between all opposing segments ) In addition to the sharp interior angles which define the X shape, a pair of 90° angles separates opposite sides (such as 30*a* and 30*b*) of each of the segments (such as segment 30). Due to the sharp angles and the mild agitation of the water bath 60, laminar water flow (indicated by arrows 25*a*, 25*b*, 25*c* and 25*d*) does not occur along the surface of the die elements. As a result, minerals and dissolved gasses (indicated at areas 64*a*, 64*b*, 64*c* and 64*d*) cannot be flushed away from the surface of the die but are flushed away from the area between opposing dies. As shown in FIG. 4, unflushed minerals and gasses result in ice formation along the surface of each of the dies being clouded as indicated by the cloud forming bubbles shown at 64, 66 and 68 surrounding each of dies 24, 26 and 28, respectively. Likewise, FIG. 4 also shows a clear area spaced away from each of the dies and indicated by the clear ice 74, 76 and 78 surrounding each of dies 24, 26 and 28, respectively.

As coolant continues to flow through tube 22, the dies 24, 26 and 28 continue to extract heat from the water bath 60. As a result ice formation around each of the dies continues to grow. However, the rate of growth of the ice formation may slow since the ice surrounding each of the dies acts as an insulator. The thermal conductivity of ice is very low compared to the conductive material such as copper or aluminum from which the dies are formed. The thicker the ice surrounding each of the dies become, the greater the resistance there is to additional ice formation on a given die. The close proximity of dies within a sequence results in opposing dies cooperating to freeze water between the dies and form a single cube of relatively large size. For example, the Y-die and Z-die cooperate to freeze water between them such that their clear ice portions 76 and 78 will join to form a single cube of ice. When this occurs, all clear portions 74, 76 and 78 will be joined into a common clear portion 79 surrounding all of dies 24, 26 and 28 as shown in FIG. 5.

While the dies within a sequence are spaced close together, dies of different sequences are spaced far apart. As a result, once a completed cube 80 is formed around dies 24, 26 and 28 it will be slow to grow further due to the low conductivity of the ice. Therefore, due to the increased spacing between opposing dies of different segments (such as the spacing between die 28 and die 24'), the completed ice cube 80 surrounding the first sequence of dies 24, 26 and 28 will not grow to join with the completed ice cube 80' surrounding dies 24' and 26'.

When a completed ice cube 80 is joined forming ice surrounding each of dies 24, 26 and 28 and the growth of completed ice cube 80 is retarded, the apparatus 20 and its associated ice cubes are lifted from the water bath 60. The ice cubes 80 may be removed from the apparatus 20 by pumping a warm liquid through tube 22 and heating the dies 24, 26 and 28 to a temperature above the melting point of the water. As a result, a thin film of water will be formed at the interface between the die surfaces and the ice cube thereby permitting the ice cube to drop off of the dies.

A completed ice cube is shown in the view of FIG. 11 which shows an ice cube when viewed from its upper surface which was opposing the bottom of tube 22. As shown in FIG. 11, the completed ice cube 80 includes voids or imprints such as imprint 94, imprint 96 and imprint 98 which conform with the shape and configuration of cross sections of X-die 24, Y-die 26 and Z-die 28. Also shown in FIG. 11 and indicated by bubble formations 64, 66 and 68 is that the ice cube is cloudy in appearance only around imprints 94, 96 and 98 and is clear in the remainder of the ice cube as indicated by numeral 79. The localized cloudiness of the ice cube around each of the imprints is due to the absence of laminar flow of water due to the mild agitation and the sharp edges and angles of each of the die elements. The benefit of this localized clouding is most remarkable when the ice cube is placed into a liquid such as water. In the absence of localized clouding, a clear ice cube becomes generally transparent in water. The addition of the localized ice cubes highlights the outline of the imprints and, when the ice cube is placed in water, makes the imprints and their monogram (or imprinted message) visible. This is most desirable in the promotion of a company of its product where it is desired to have a consumer notice and comprehend the monogram.

With reference to FIGS. 12 through 14, a second embodiment of the present invention will be described with reference to a die having opposing surfaces which define a bounded volume. With respect to letters of the alphabet, the letters "A", "B", "D", "O", "P" and "Q" all include an enclosed bounded area. If a die were to be formed having a cross sectional area which was true to the letter, the resulting ice cube would include a volume of ice which was defined within a completely bounded portion of the letter. However, even though the ice in its water bath is subject to mild agitation, the agitation is not sufficient to clear the bounded volume of dissolved minerals and gasses. As a result, the entire area within the bounded confines of the letter would appear cloudy. Thus, the completed ice cube would not enjoy the full benefits of the present invention in that it is desired only to have the ice immediately adjacent the surfaces of the letter being clouded. To this end, a slit is formed along the entire longitudinal length of the die to provide increased water flow communication between the water bath and the interior of the bounded volume. By way of example, this is shown with a die element 124 which will be used to make an ice cube 180 having an imprint which in the shape of the letter "P". As shown in FIG. 13, the die extends downwardly from the bottom of tube 22 and has a cross sectional area in the shape of a "P". With reference to FIG. 12, the "P" is shown backwards in that the view of FIG. 12 is taken from the bottom of the view of FIG. 13 and looking upwardly. The P-die includes a first plate segment 130 which is provided with a loop portion 131 to define the cross section of a "P". The loop portion 131 and segment 130 define an enclosed volume 132. An elongated slot 133 is formed along the longitudinal length of the loop portion 131 to provide increased water flow communication between the bounded volume 132 and the bath of water 60.

FIG. 14 shows a completed ice cube 180 which was formed about a P-die 124. The completed ice cube 180 includes an imprint 194 in the shape of a "P" and includes a clouded layer 164 of ice surrounding the imprint 194. The narrow clouded layer 164 is formed according to the method described above and is attributable to the mild agitation and shape of the P-die which is not conducive with laminar flow. The volume of ice formed within the "P" includes a thin layer of clouded ice 164' surrounding the surface of the imprint 194 and a clear area of ice 165 within the remainder of the volume of the ice. The clear portion 165 is due to the passage of water flow from within the enclosed volume 132 of loop portion 131 which is available by reason of water flow through slit 133. In the absence of such a slit 133, the entire area bounded by the loop portion of the "P" would be clouded and less appealing. Due to slit 133, a small bridge 167 of ice interrupts the loop portion of the "P" imprint. However, this is quite small and generally more appealing than a completely clouded interior.

The foregoing descriptions have described the present invention and have shown how a monogrammed ice cube can be formed which includes a thin layer of clouded ice surrounding a desired imprint. The thin layer of clouded ice provides enhanced visibility to the ice cube when it is placed in water.

In addition to providing monogrammed ice cubes, it is desirable to produce ice cubes of a novelty variety with predetermined and variable contours. The shape of the contours are dependent on the shape of the die elements. The die elements extend from the refrigeration tube 22. Heat flow to the die element reduces in proportion to the distance on the point of the die element from the source of refrigeration. Also, heat flow to the die element reduces as the exposed surface of the die element is reduced. FIGS. 6 through 8 demonstrate these principles.

In FIG. 6, die elements are shown at 100 and 100*a* and both depending from a plate 101 which is in contact with a refrigerant source and acts as the cooling conduit for each of dies 100 and 100*a*. As shown in FIG. 6, dies 100 and 100*a* have blunt free ends 102, 102*a*, respectively. Due to its close proximity to the source of refrigerant, the point of the die at the water surface has the greatest heat flow and therefore the resulting ice cube will be thickest at this point. Also, the bottom of the resulting ice cube is generally flat due to the blunt end 102, 102*a*. If it would be desired to form an ice cube which is generally tapered along its full length, dies 100' and 100*a*' such as shown in FIG. 7 could be employed. As shown, dies 100' and 100*a*' taper along their entire length down to free ends 102' and 102*a*'. As a result, the resulting ice cube is tapered along its entire length. The shape of the die can further modify the shape of the ice cube as shown in FIG. 8 where the die 100" and 100*a*" is tapered only at free ends 102" and 102*a*". As a result of this configuration, the resulting ice cube is provided with a relatively blunt portion near the water surface and tapers to a relatively sharp portion toward the bottom of the ice cube.

As a result of the tendency of the formation of the ice cube to follow the geometry of the die, fanciful ice cubes of varying contours can be formed. As shown in FIGS. 9 and 10, a die 90 is shown having a plurality of peaks 91 and valleys 92 sequentially spaced around the perimeter of the die. The die 90 is secured to a plate 101*a* which is refrigerated. An ice cube 95 forms around the die 90 when the die 90 is immerged in a water bath 97 and a coolant cools plate 101. The resulting ice cube is shown in FIG. 15 and has a plurality of rounded peaks 91' and valleys 92' which correspond to the peaks 91 and valleys 92 of die 90. As a result, by alternating and arranging the peaks and valleys of the die a decorative cube of predetermined and controlled contours can be formed.

From the foregoing detailed description of the present invention, it has been shown how the objects of the invention have been attained in a preferred manner. However, modification and equivalents of the disclosed concepts such as readily occur to those skilled in the art are intended to be included in the scope of this invention. Thus, the scope of the invention is intended to be limited only by the scope of the claims that are, or may hereafter be, appended hereto.

What I claim is:

1. A method of forming a monogrammed cube of frozen liquid comprising:
   - forming a die of conductive material having a shape corresponding to a shape of a desired imprint to be formed in said cube;
   - conductively connecting said die to a source of a coolant;
   - contacting said die with a liquid to be frozen;
   - cooling said die with said coolant to a temperature below a freezing point of said liquid with said liquid freezing around said die;
   - continue freezing said liquid around said die under conditions with frozen liquid adjacent said die being clouded and frozen liquid spaced from said die being clear until a completed cube is formed on said die;
   - removing said completed cube from said die.

2. A method according to claim 1 comprising immersing said die in a bath of said liquid and agitating said liquid at a rate for liquid adjacent said die being generally unagitated and liquid spaced from said die being agitated.

3. A method according to claim 2 wherein said die is formed with surfaces of said die being shielded from laminar flow of agitated liquid.

4. A method according to claim 1 comprising forming a composite die including a plurality of individual dies;
   - freezing liquid around each individual die with opposing dies cooperating to freeze liquid between said dies;
   - continue freezing said liquid until frozen liquid about said individual dies grows to bond with frozen liquid about opposing dies to form a completed cube.

5. A method according to claim 2 comprising forming said die with a bounded interior and forming an opening through said die to expose said interior;
   - agitating said liquid at a rate to form frozen liquid within said interior which is occluded adjacent said die and clear spaced from said die.

6. A method according to claim 1 wherein said die has a shape corresponding to a letter of the alphabet.

7. A method for forming a monogrammed cube of ice from water containing impurities which cloud an ice cube formed from the water if the impurities are not washed from the ice cube during its formation, the method comprising:

forming a die of conductive material having a shape corresponding to a shape of a desired imprint to be formed in said cube;

conductively connecting said die to a source of a coolant;

immersing said die within liquid water;

cooling said die with said coolant to a temperature below a freezing point of the water with said water forming ice crystals around said die;

agitating said water at a rate selected to wash impurities away from ice forming on said cube and spaced from said die and leaving impurities within ice forming adjacent said die whereby said ice forms about said die into a completed cube with a desired imprint in said cube and said imprint visibly enhanced by cloudiness of said cube immediately surrounding said imprint contrasting with clarity of said cube spaced from said imprint.

* * * * *